US009982870B1

(12) United States Patent
Liao et al.

(10) Patent No.: US 9,982,870 B1
(45) Date of Patent: May 29, 2018

(54) ILLUMINATING DEVICE AND METHODS FOR MAKING THE SAME

(71) Applicant: TAIWAN GREEN POINT ENTERPRISES CO., LTD., Taichung (TW)

(72) Inventors: Pen-Yi Liao, Taichung (TW); Chung-Ho Liu, Taichung (TW); Hung-Chun Chen, Taichung (TW)

(73) Assignee: Taiwan Green Point Enterprises Co., Ltd., Taichung (TW)

( * ) Notice: Subject to any disclaimer, the term of this patent is extended or adjusted under 35 U.S.C. 154(b) by 0 days. days.

(21) Appl. No.: 15/880,633

(22) Filed: Jan. 26, 2018

Related U.S. Application Data

(63) Continuation of application No. 14/628,845, filed on Feb. 23, 2015, now Pat. No. 9,903,565.

(30) Foreign Application Priority Data

Feb. 25, 2014 (TW) ..... 103106273 A

(51) Int. Cl.
*F21V 7/00* (2006.01)
*F21V 15/01* (2006.01)
*F21Y 115/10* (2016.01)

(52) U.S. Cl.
CPC ..... *F21V 15/01* (2013.01); *F21Y 2115/10* (2016.08); *Y10T 29/49117* (2015.01)

(58) Field of Classification Search
CPC ..... F21V 15/01
USPC ..... 362/296.01
See application file for complete search history.

(56) References Cited

U.S. PATENT DOCUMENTS 6,386,732 B1 * 5/2002 Shiau ..... F21L 4/005 362/202
7,417,220 B2 * 8/2008 Suehiro ..... H01L 23/3121 250/239
7,420,221 B2 * 9/2008 Nagai ..... H01L 33/505 257/100
7,439,548 B2 * 10/2008 Shum ..... H01L 33/382 257/100
7,777,246 B2 * 8/2010 Hung ..... H01L 33/56 257/79

(Continued)

FOREIGN PATENT DOCUMENTS

TW 200919659 A 5/2009
TW M368100 U1 11/2009
TW 201352097 A 12/2013

*Primary Examiner* — Bryon T Gyllstrom
(74) *Attorney, Agent, or Firm* — Volpe and Koenig, P.C.

(57) ABSTRACT

An illuminating device includes an insulative housing, at least two electrodes and a light source. The insulative housing has opposite front and rear surfaces and is formed with at least two through holes. Each of the through holes is defined by a hole wall and penetrates the front and rear surfaces. Each of the electrodes includes a first conductive segment formed proximate the front surface, a second conductive segment formed proximate the rear surface, and a connecting segment formed inside a respective one of the through holes and interconnecting electrically the first and second conductive segments. The light source is disposed on the front surface and includes first and second connecting terminals each being electrically coupled to the first conductive segment of a corresponding one of the electrodes.

20 Claims, 18 Drawing Sheets

(56) References Cited

U.S. PATENT DOCUMENTS

| | | | | |
|---|---|---|---|---|
| 8,148,738 | B2 * | 4/2012 | Murayama | H01L 23/147 257/778 |
| 8,523,626 | B2 * | 9/2013 | Suehiro | H01L 33/501 313/512 |
| 2006/0012967 | A1 * | 1/2006 | Asai | G02B 6/43 361/764 |
| 2006/0261364 | A1 * | 11/2006 | Suehiro | H01L 33/56 257/100 |
| 2008/0099770 | A1 * | 5/2008 | Mendendorp | H01L 33/64 257/79 |
| 2009/0272562 | A1 * | 11/2009 | Yoshioka | H05K 1/162 174/250 |

* cited by examiner

ILLUMINATING DEVICE AND METHODS FOR MAKING THE SAME

CROSS REFERENCE TO RELATED APPLICATIONS

This application is a continuation of U.S. patent application Ser. No. 14/628,845, filed Feb. 23, 2015, which claims priority to Taiwanese Patent Application No. 103106273, filed on Feb. 25, 2014, all of which are hereby incorporated by reference as if fully set forth.

FIELD OF THE INVENTION

Embodiments of the invention generally relate to illuminating devices and methods for making the same.

BACKGROUND OF THE INVENTION

Referring to FIG. 1, an illuminating device 1, such as a vehicle lamp, is shown to include a lamp cover 11, a flexible printed circuit board 12, a plurality of light-emitting diodes 13 disposed on the flexible printed circuit board 12, and a substrate 14. The lamp cover 11 has a plurality of cover bodies 111 each of which is formed with a through hole 112. The substrate 14 has a main body 141 for supporting the flexible printed circuit board 12, and pairs of heat rivets 142 protruding from one side of the main body 141 to interconnect the lamp cover 11 and the substrate 14.

When assembling the aforesaid illuminating device, the light-emitting diodes 13 are first disposed onto the flexible printed circuit board 12, followed by bending the flexible printed circuit board 12 into a wave-like structure, including a plurality of spaced-apart arc portions 121 and a plurality of flat portions 122 alternately arranged with the arc portions 121. Thereafter, the flat portions 122 are then disposed onto the main body 141 of the substrate 14, such that the heat rivets 142 extend respectively through engaging holes 123 which are formed in the flat portions 122. Then, the lamp cover 11 is disposed onto the soft printed circuit board 12, such that each of the light-emitting diodes 13 is received in the through hole 122 of a respective one of the cover bodies 111 and that each of the arc portions 121 is disposed between two adjacent cover bodies 111. Finally, the heat rivets 142 are hot-melted to interconnect the substrate 14 and the lamp cover 11. However, since the heat rivets 142 need to be hot-melted to interconnect the substrate 14 and the lamp cover 11, and since the illuminating device 1 has a relatively large amount of components, labor cost as well as the assembling time may be increased, resulting in relatively high production costs.

SUMMARY OF THE INVENTION

Certain embodiments of the present invention provide illuminating devices that may alleviate at least one of the aforementioned drawbacks, and/or methods for making the same.

In certain embodiments, such an illuminating device may include an insulative housing, a pair of electrodes and a light source. The insulative housing includes at least substantially oppositely disposed front and rear surfaces and a pair of spaced-apart through holes. Each of the through holes is defined by a hole wall and penetrates the front and rear surfaces. Each of the electrodes includes a first conductive segment that is formed proximate the front surface, a second conductive segment that is formed proximate the rear surface, and a connecting segment formed inside a respective one of the through holes and electrically interconnects the first and second conductive segments. The light source is disposed proximate the front surface and includes first and second connecting terminals. Each of the connecting terminals is electrically coupled to the first conductive segment of a corresponding one of the electrodes.

In certain embodiments of the present invention, a method for making an illuminating device may be provided. Such a method may include: providing an insulative housing having at least substantially oppositely disposed front and rear surfaces and a pair of spaced-apart through holes, each of the through holes being defined by a hole wall and penetrating the front and rear surfaces; forming a pair of layered active metal parts respectively on the hole walls of the through holes and extending from the hole walls to a portion of each of the front and rear surfaces; forming first layered metal parts respectively on the layered active metal parts, where the first layered metal parts respectively cooperating with the layered active metal parts to constitute two electrodes each having a first conductive segment formed proximate the front surface, a second conductive segment formed proximate the rear surface, and a connecting segment formed inside the hole wall and electrically interconnecting the first and second conductive segments; and disposing a light source proximate the front surface, and connecting a first connecting terminal and a second connecting terminal of the light source correspondingly to the first conductive segments of the electrodes.

Such a method for making an illuminating device may include: providing an insulative housing including at least substantially oppositely disposed front and rear surfaces, and at least one through hole defined by a hole wall and penetrating the front and rear surfaces; forming an electrode inside the through hole, wherein the electrode extends to the front and rear surfaces and includes a layered active metal part formed on the hole wall, and a first layered metal part formed on the layered active metal part; and disposing a light source proximate the front surface and connecting electrically at least one connecting terminal of the light source to one end of the electrode extending to the front surface of the insulative housing.

BRIEF DESCRIPTION OF THE DRAWINGS

Other features and advantages of the present invention will become apparent in the following detailed description of the exemplary embodiments with reference to the accompanying drawings, of which.

DETAILED DESCRIPTION OF THE EXEMPLARY EMBODIMENTS

Figure 1:
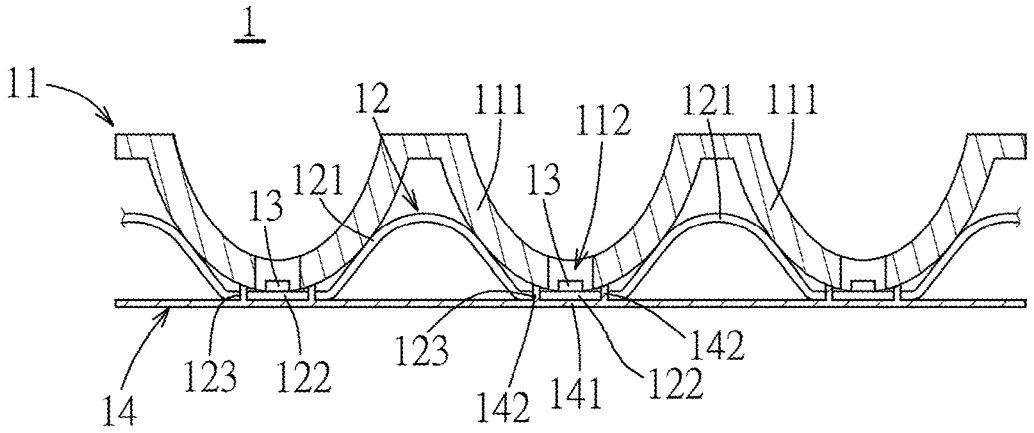
FIG. 1 PRIOR ART
FIG. 1 is a fragmentary sectional view, illustrating an illuminating device.
Figure 2:
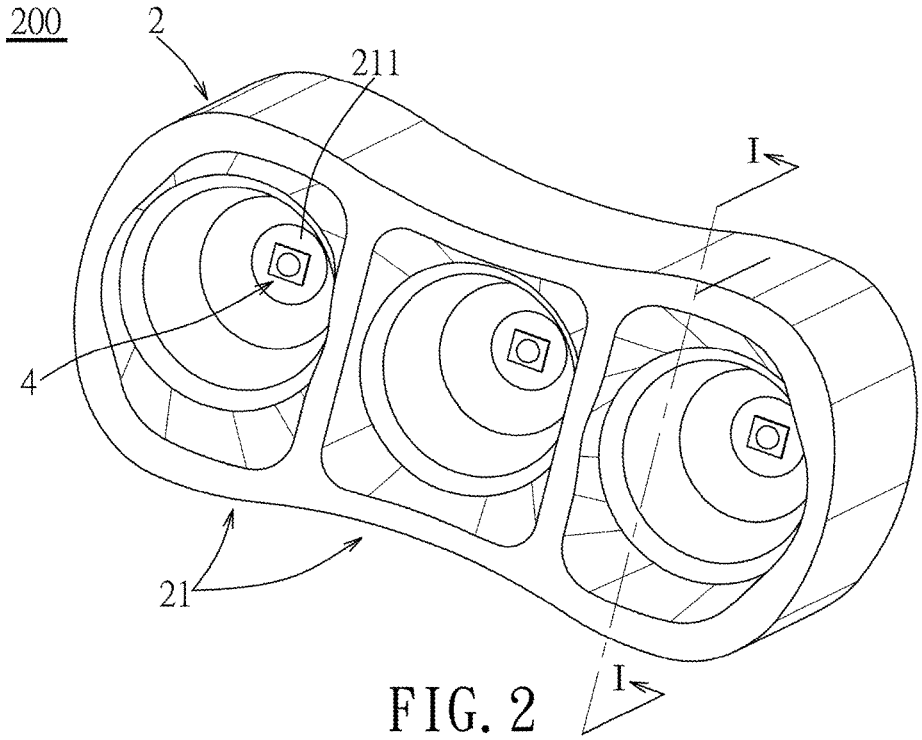
FIG. 2 is a perspective view, illustrating an illuminating device of one embodiment.
Figure 3:
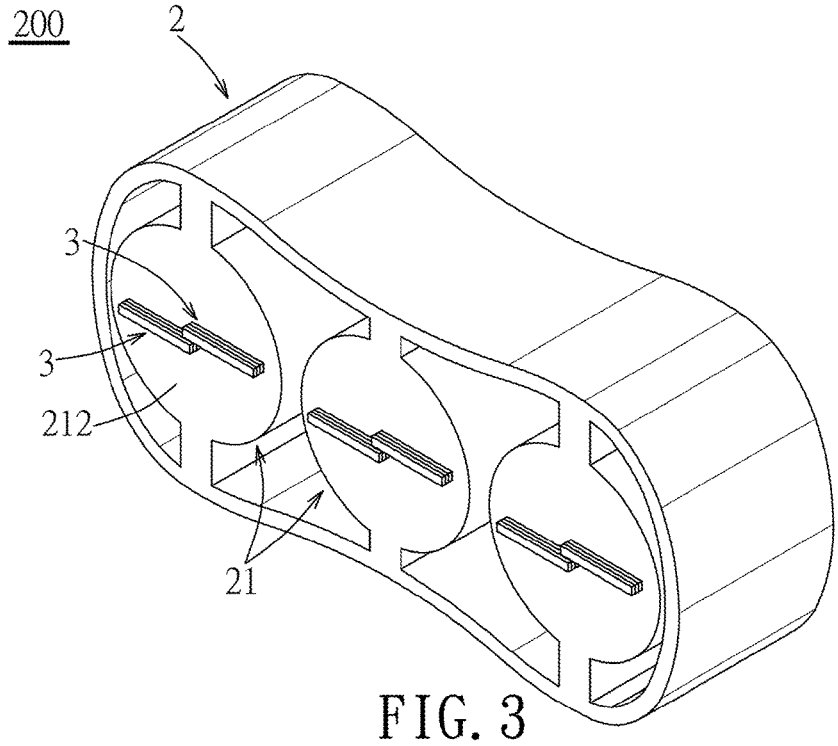
FIG. 3 is another perspective view.

It may be noted that like elements are denoted by the same reference numerals throughout the disclosure.

Referring to FIGS. 2 to 5, an embodiment of an illuminating device 200 according to the present invention is shown to include an insulative housing 2, a plurality of electrodes 3 and a plurality of light sources 4. The illuminating device 200 is exemplified as a vehicle lamp, but it can be other types of illuminating devices and is not limited to the disclosure of this embodiment according to the present invention.

Figure 4:
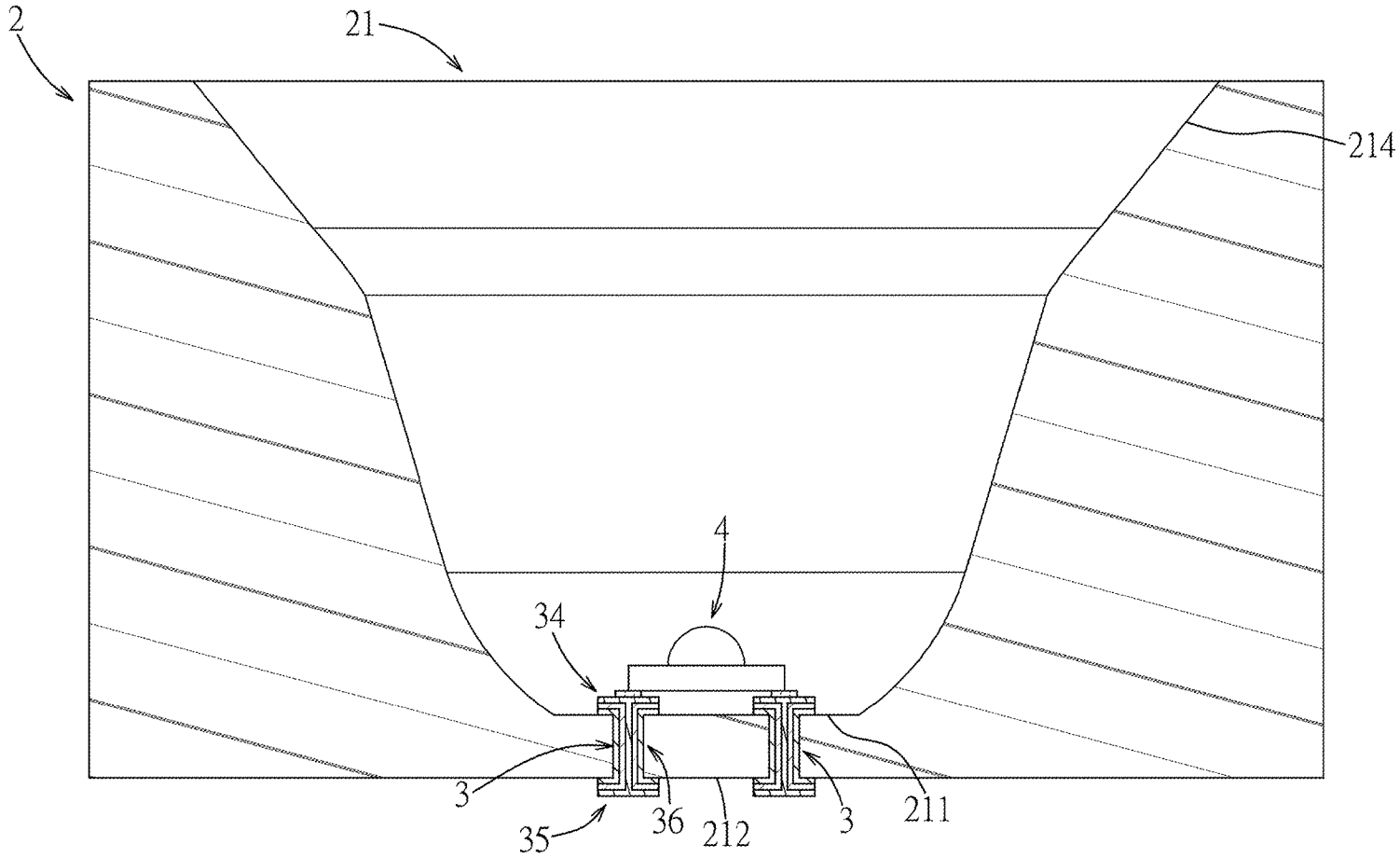
FIG. 4 is a sectional view taken along line I-I in FIG. 1.

As shown in FIGS. 2 to 5, insulative housing 2 includes a plurality of integrally-formed mount bodies 21 and may be made of an electrically-insulative material, such as plastic materials. The number of the mount bodies 21 of the insulative housing is not limited to what is disclosed in this embodiment, and to include only one mount body 21 may also suffice for the insulative housing 2. Mount body 21 has opposite front and rear surfaces 211, 212 and is formed with a pair of through holes 215, each of which is defined by a hole wall 213 and penetrates the front and rear surfaces 211, 212, correspondingly. As shown in FIG. 4, each of the mount bodies 21 may further include a surrounding surface 214 that extends around and projects outwardly from a periphery of a respective one of the front surfaces 211.

Figure 5:
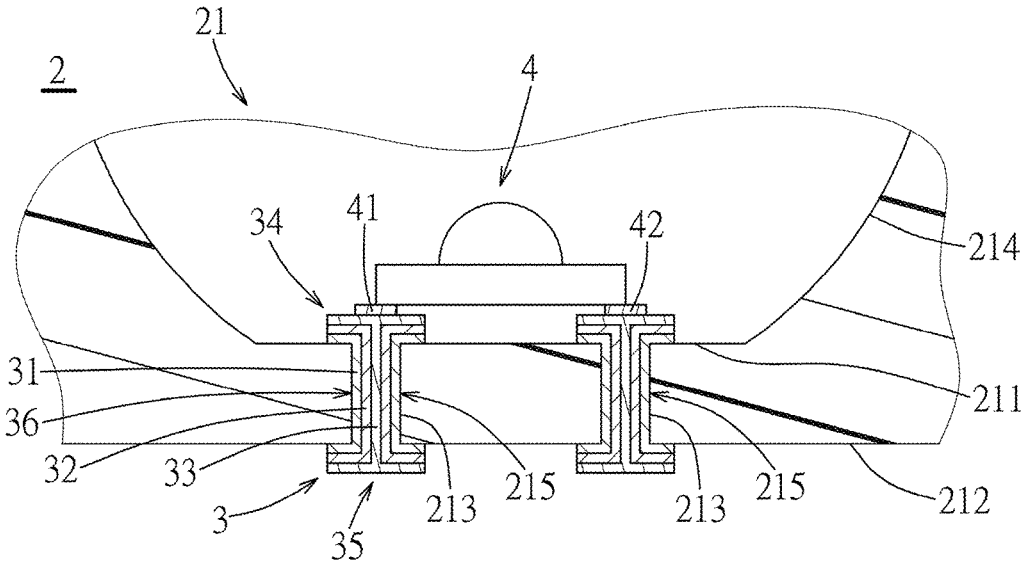
FIG. 5 is a partly enlarged sectional view of FIG. 4.

As shown in FIG. 5, each of the electrodes 3 is disposed correspondingly in position to a respective one of the through holes 215 and includes a layered active metal part 31, a first layered metal part 32 and a second layered metal part 32. The layered active metal part 31 of each of the electrodes 3 is formed on and extends from the hole wall 213 of the respective one of the through holes 215 to a portion of each of the front and rear surfaces 211, 212. For each of the electrodes 3, the first layered metal part 32 is formed on the layered active metal part 31, and the second layered metal part 33 is formed on the first layered metal part 32. In the embodiment of FIGS. 4 and 5, the layered active metal part 31, the first layered metal part 32 and the second layered metal part 33 of each of the electrodes 3 cooperatively constitute a first conductive segment 34 formed at the front surface 211, a second conductive segment 35 formed at the rear surface 212, and a connecting segment 36 that is formed inside the respective one of the through holes 215 and that interconnects the first and second conductive segments 34, 35. It should be noted that, although each of the electrodes 3 of this embodiment has a three-layered structure (i.e., to include the layered active metal part 31, the first layered metal part 32 and the second layered metal part 33) to constitute the first conductive segment 34, the second conductive segment 35 and the connecting segment 36, electrodes 3 may be configured differently as well, such as in a two-layered structure instead (i.e., to only include the layered active metal part 31 and the first layered metal part 32).

In certain embodiments, the layered active metal parts 31 may be made of an active metal material, and examples of the active metal material may be, but are not limited to, palladium, rhodium, platinum, iridium, osmium, gold, nickel, ferrite and combinations thereof. In certain embodiments, each of the first layered metal parts 32 and the second layered metal parts 33 may be made of an electrically conductive material, such as a metal. Such a metal may, in certain embodiments, be selected from the group consisting of copper, gold, silver, nickel and combinations thereof.

Light sources 4 are respectively disposed on the front surfaces 211 of the mount bodies 21. Each of the light sources 4 includes first and second connecting terminals 41, 42. Each of the first and second connecting terminals 41, 42 is electrically coupled to the first conductive segment 34 of a corresponding one of the electrodes 3. In certain embodiments, the light sources 4 may take the form of light-emitting diodes, but other sources may be used in other embodiments according to the present invention. In addition, in certain embodiments, a power source (not shown in Figures) may be electrically coupled to the second conductive segments 35 of the electrodes 3 by power transmission lines for providing electrical power to the light sources 4 via the electrodes 3. It may be noted that the number of the light sources 4 corresponding to one mount body 21 is not limited to the disclosure of this embodiment (i.e., multiple light sources 4 may be disposed on the front surface 211 of one single mount body 21). In certain embodiments, the number of the through holes 215 corresponds to the number of the light sources 4.

In certain embodiments, a reflective metal cover may be formed on the surrounding surface 214 of each of the mount bodies 21 for reflecting light generated from the light source 4.

Figure 6:
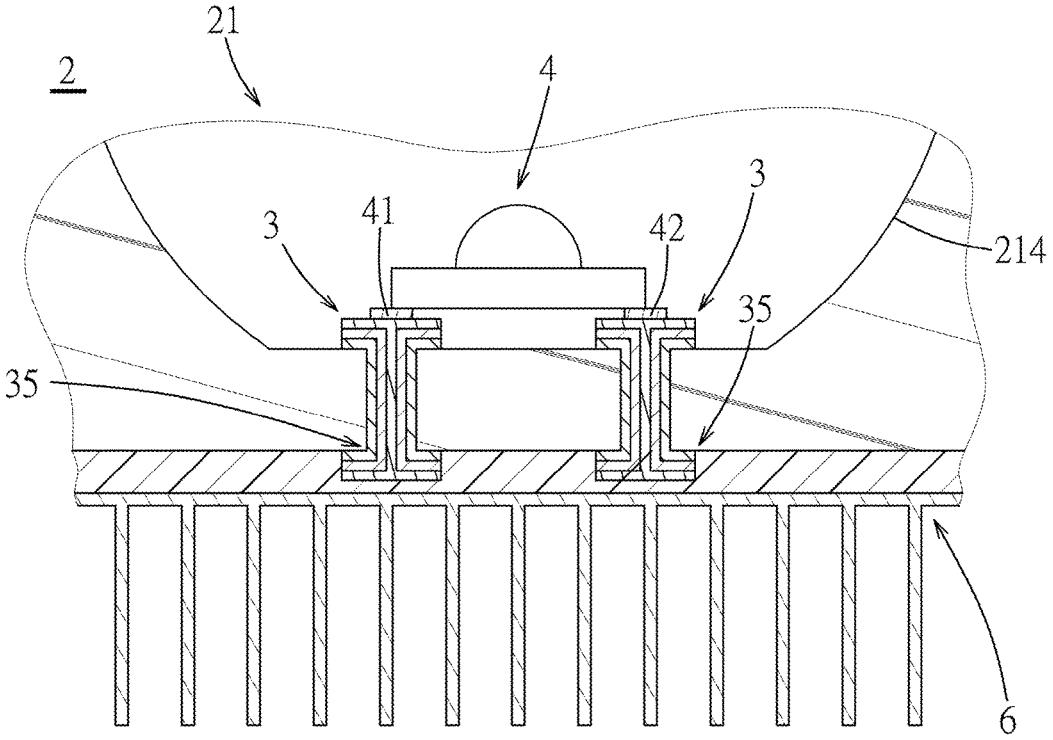
FIG. 6 is another enlarged sectional view, illustrating that a heat sink may be provided.
Figure 7:
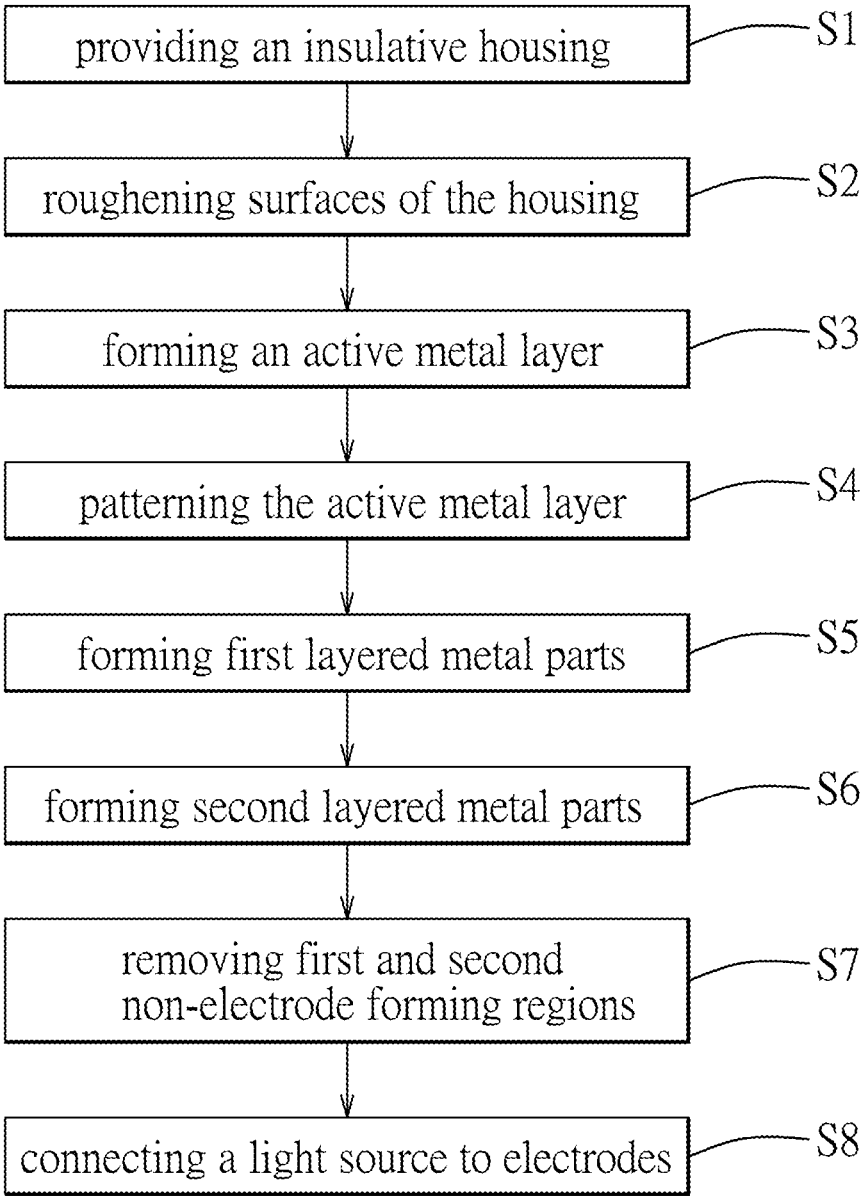
FIG. 7 is a flow chart illustrating a method of one embodiment for making the illuminating device.
Figure 8:
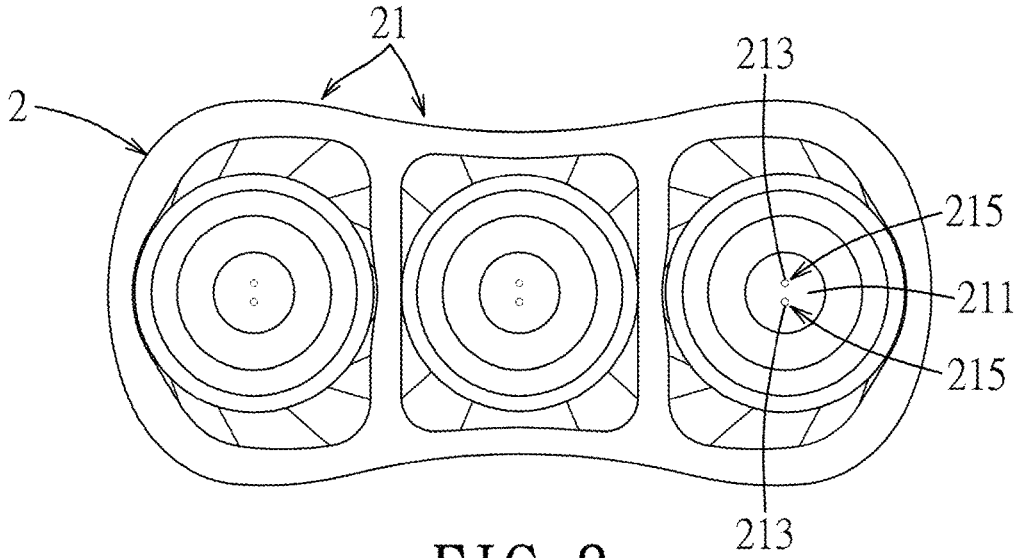
FIG. 8 is a schematic view, illustrating providing an insulative housing formed with through holes.

Since the illuminating device 200 has relatively few components, a relatively reduced production cost and a simplified manufacturing process may be realized. In addition, in certain embodiments, a three-layered structure of the electrodes 3 (i.e., the layered active metal part 31, the first layered metal part 32 and the second layered metal part 33) not only can provide stable electrical transmission, but may serve as heat dissipating paths for the light sources 4. In certain embodiments (for instance, as described in FIG. 6), the second connecting segments 35 of the electrodes 3 may have direct contact with a heat sink 6 to allow heat generated from the light sources 4 to be transmitted to the heat sink 6 through the electrodes 3, so as to effectively improve heat dissipating efficiency of the illuminating device 200 as compared to the aforementioned illuminating device of the prior art.

Referring to FIGS. 7 to 16, a method suitable for making the illuminating device 200 (FIG. 7) according to certain embodiments of the present invention is shown.

As illustrated at step S1 (FIG. 7), an insulative housing 2 (see FIG. 8) may be provided. The insulative housing 2 may be made of plastic materials, by way of non-limiting example. Although the insulative housing 2 of this embodiment includes a plurality of mount bodies 21, only one mount body 21 will be described hereinbelow for the sake of clarity, and the number of the mount bodies 21 should not be limited. The mount body 21 has opposite front and rear surfaces 211, 212 and is formed with a pair of through holes 215. Each of the through holes 215 is defined by a hole wall 213 and penetrates the front and rear surfaces 211, 212 (see FIG. 11). In certain embodiments, the mount body 21 may further include a surrounding surface 214 that extends around and projects outwardly from the front surface 211. In certain embodiments, the through holes 215 may be formed by mechanical drilling or by laser ablation.

Figure 9:
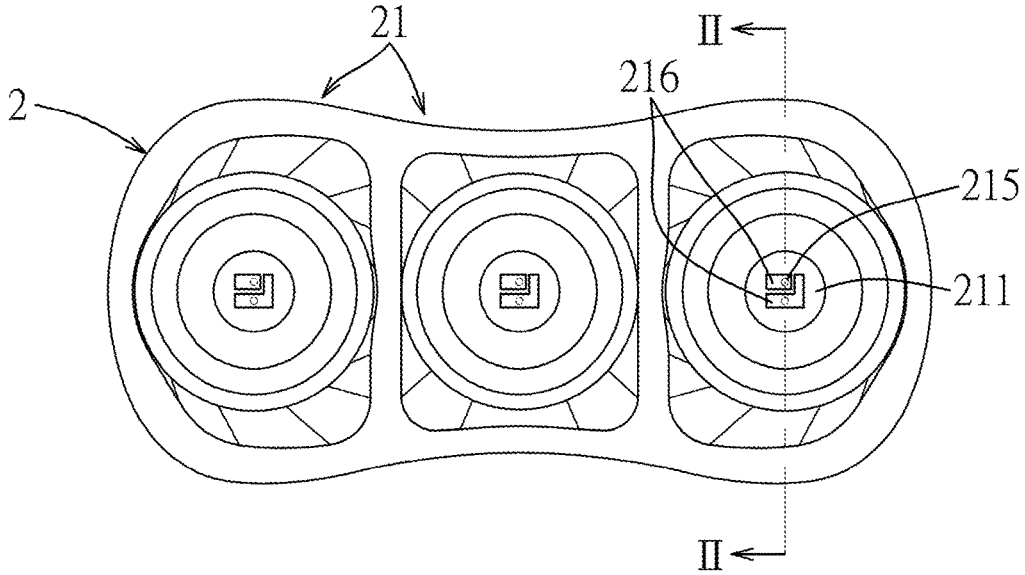
FIG. 9 is a schematic view, illustrating roughening of front surfaces of the insulative housing.
Figure 10:
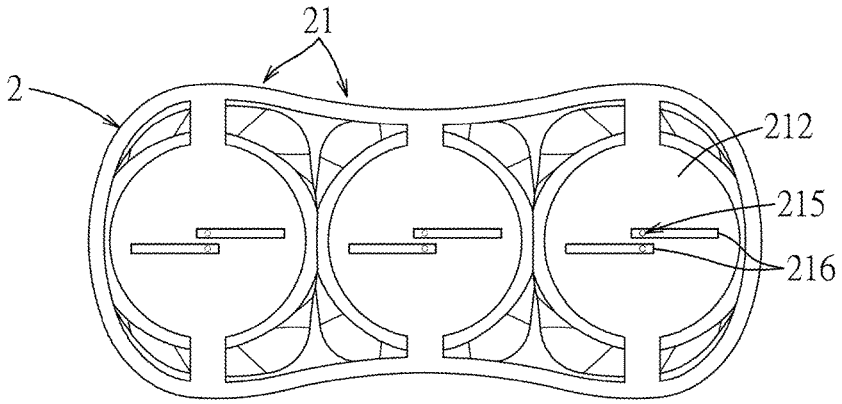
FIG. 10 is another schematic view, illustrating roughening of the rear surfaces of the insulative housing.
Figure 11:
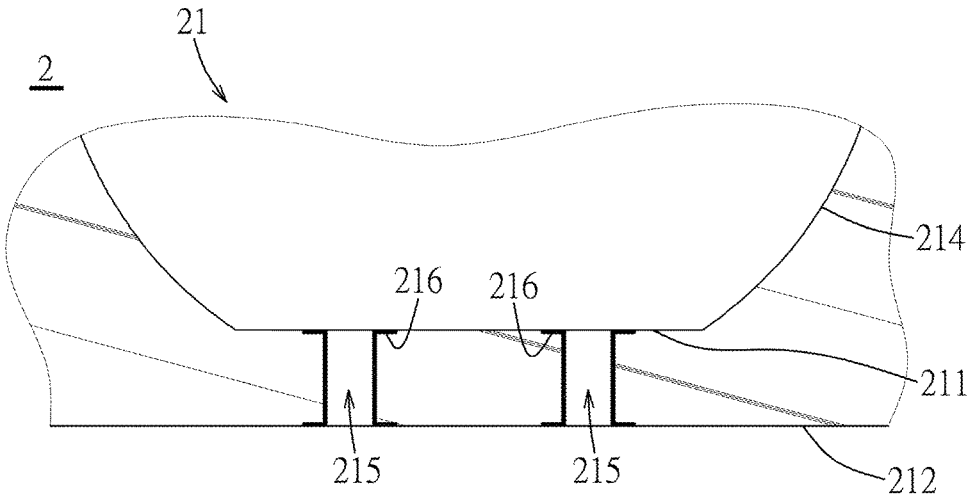
FIG. 11 is a partly enlarged sectional view taken along line II-II in FIG. 9.

As illustrated at Step S2 (FIG. 7), the hole walls 213 of the through holes 215 and a portion of each of the front and rear surfaces 211, 212 may be roughened to define a pair of roughened zones 216 corresponding in position to the through holes 215 (see FIGS. 9 to 11). In this embodiment, Step S2 may be conducted by laser ablation or by chemical etching.

Figure 12:
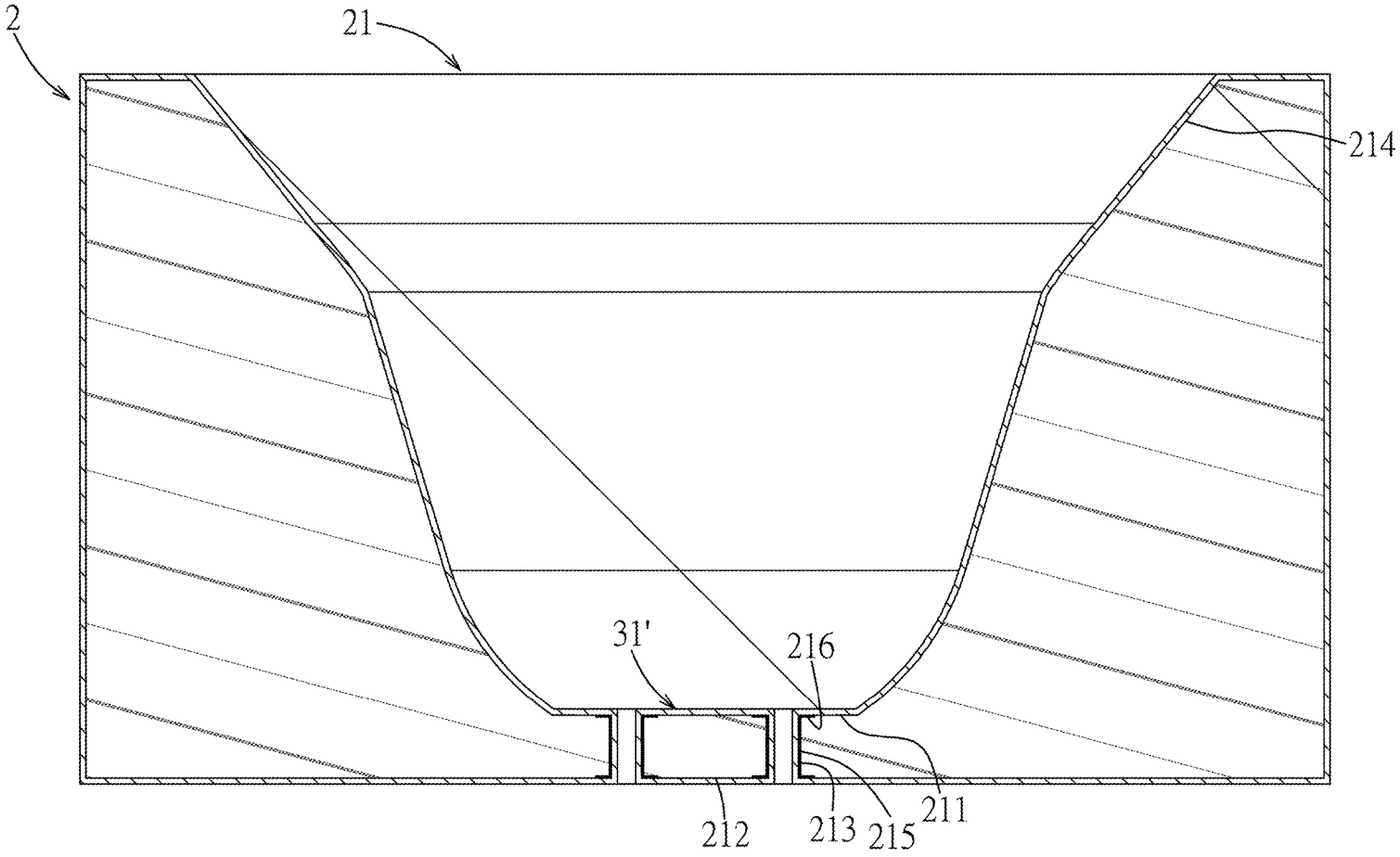
FIG. 12 is a sectional view, illustrating forming of an active metal layer.

As illustrated at Step S3 (FIG. 7), an active metal layer 31' may be formed on the hole walls 213 of the through holes 215, the surrounding surface 214 and the front and rear surfaces 211, 212 (see FIG. 12). In this embodiment, the forming of the active metal layer 31' may be conducted by immersing the whole insulative housing 2 into an aqueous active metal solution, followed by removing the same therefrom. Thereafter, the insulative housing 2 may be rinsed sequentially by dilute sulfuric acid and water, and then dried to form the active metal layer 31'. The aqueous active metal solution may be, but is not limited to, a palladium-tin colloid solution. It should be noted that, in certain embodiments, the forming of the active metal layer 31' may be conducted by printing and is not limited to the disclosure of this embodiment according to the present invention. The mount body 21 having a pair of the roughened zones 216 may advantageously assist the active metal layer 31' to be firmly attached thereto in certain embodiments of the invention. Such a layer may be continuous in certain embodiments of the invention.

Figure 13:
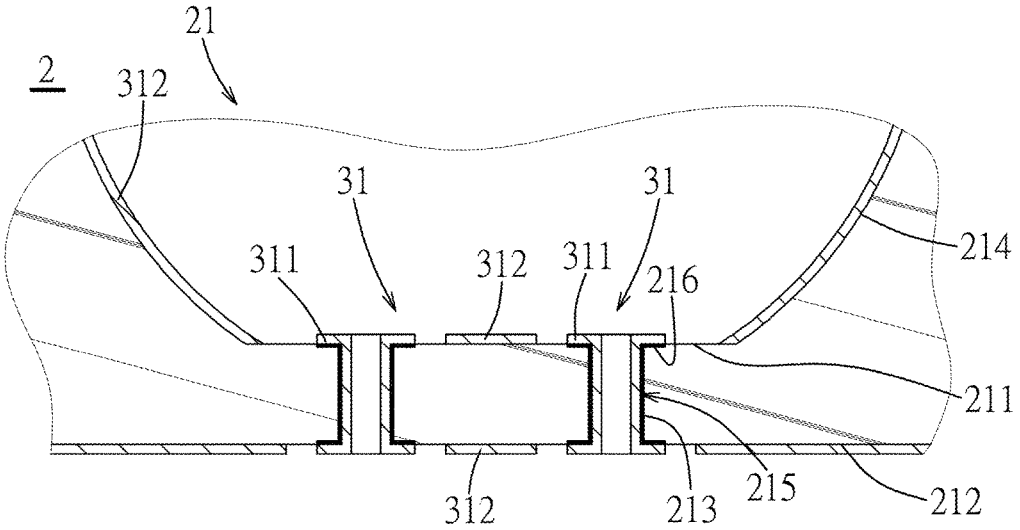
FIG. 13 is a partly enlarged sectional view, illustrating forming of layered active metal parts.

As illustrated at Step S4 (FIG. 7), the active metal layer 31' on the mount body 21 may be formed into a pair of layered active metal parts 31 (see FIG. 13). In this embodiment, the forming of the active metal layer 31' into the layered active metal parts 31 may include patterning the active metal layer 31' to form a pair of first electrode-forming regions 311, which may respectively correspond in position to the roughened zones 216 and which in turn form the layered active metal parts 31, and a plurality of first non-electrode forming regions 312 that are spaced apart from the first electrode-forming regions 311. One of the first non-electrode forming regions 312 may be formed on the surrounding surface 214. In such an embodiment, the patterning of the active metal layer 31' may be conducted using a laser, such as an yttrium-aluminum-garnet (YAG) laser.

Figure 14:
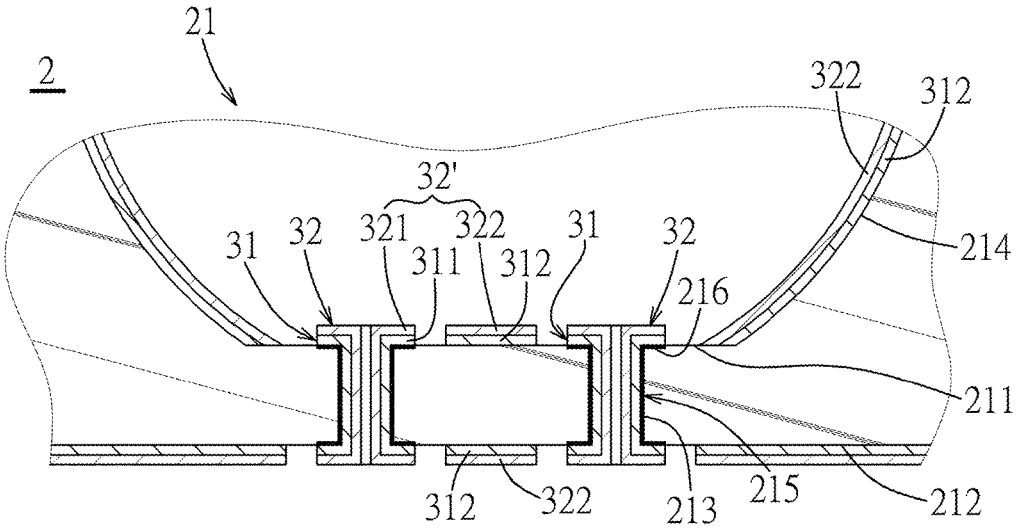
FIG. 14 is a partly enlarged sectional view, illustrating forming of first layered metal parts.

As illustrated at Step S5 (FIG. 7), a pair of first layered metal parts 32 may be formed respectively on the layered active metal parts 31 (i.e., the first electrode-forming regions 311) (see FIG. 14). The forming of the first layered metal parts 32 may include forming a patterned first metal layer 32', including a pair of second electrode-forming regions 321, which in turn form the first layered metal parts 32, and a plurality of second non-electrode forming regions 322 that are spaced apart from the second electrode-forming regions 321 and that are respectively formed on the first non-electrode forming regions 312. The second electrode-forming regions 321 of the patterned first metal layer 32' may be respectively formed on the first electrode-forming regions 311. Forming first layered metal parts 32 may be conducted by electroless plating using an electroless-plating solution containing copper or nickel, for example. In certain embodiments, forming first layered metal parts 32 may be conducted by printing a conductive ink, which contains conductive metal particles, onto the layered active metal parts 31, for example.

Figure 15:
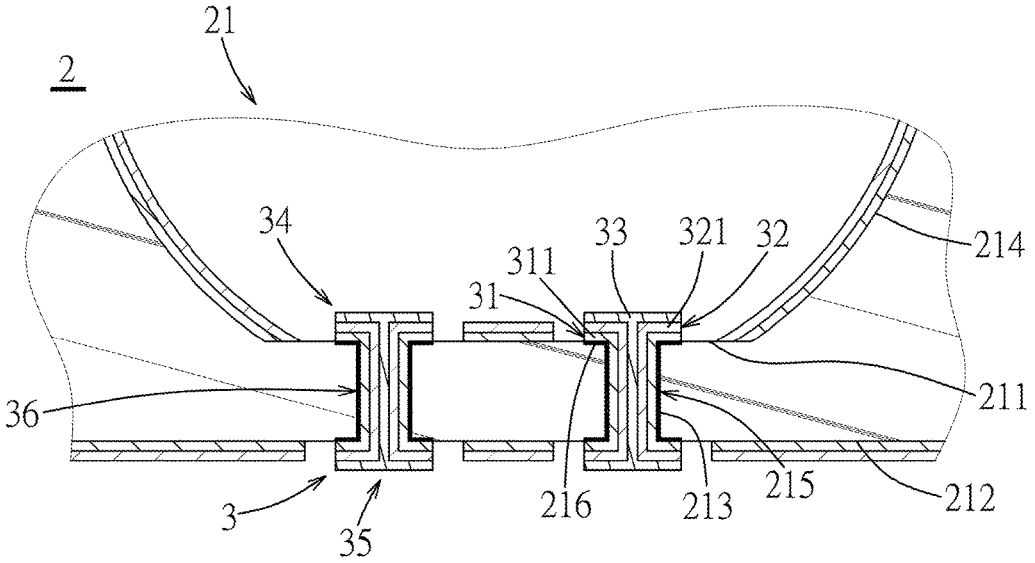
FIG. 15 is a partly enlarged sectional view, illustrating forming of second layered metal parts.
Figure 16:
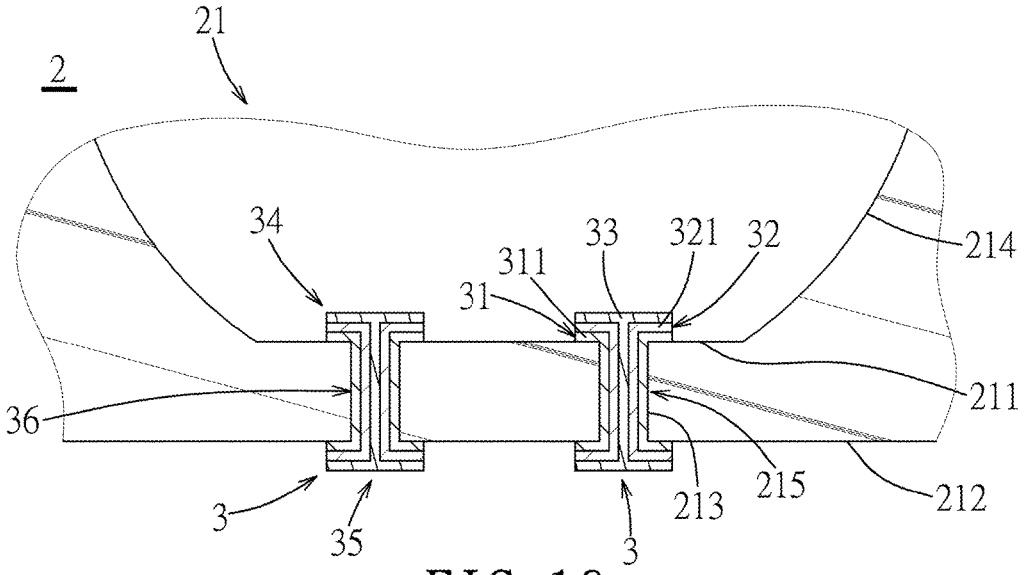
FIG. 16 is a partly enlarged sectional view, illustrating forming of electrodes.

As illustrated at Step S6 (FIG. 7), a pair of second layered metal parts 33 may be formed respectively on the first layered metal parts 32 (see FIG. 15). The forming of the second layered metal parts 32 may be conducted by selective electroplating. Each of the layered active metal parts 31 cooperates with a respective one of the first layered metal parts 32 and a respective one of the second layered metal parts 33 to constitute an electrode 3, which has a first conductive segment 34 formed at the front surface 211, a second conductive segment 35 formed at the rear surface 212, and a connecting segment 36 interconnecting the first and second conductive segments 34, 35 and formed inside a respective one of the through holes 215. The second layered metal parts 33 may be formed by electroplating using a copper electroplating solution or a nickel electroplating solution.

As illustrated at Step S7 (FIG. 7), the first non-electrode forming regions 312 of the patterned active metal layer 31' and the second non-electrode forming regions 322 of the patterned first metal layer 32' may be removed (see FIG. 16), so as to only retain the electrodes 3 at the mount body 21 of the insulative housing 2. The removal of the first and second non-electrode forming regions 311, 321 may be conducted by chemical cleaning.

As illustrated at Step S8 (FIG. 7), a light source 4 may be disposed on the front surface 211, and a first connecting terminal 41 and a second connecting terminal 42 of the light source 4 may be correspondingly connected to the first conductive segments 34 of the electrodes 3 (see FIG. 5). The connecting of the first and second connecting terminals 41, 42 may be conducted by welding, but is not limited thereto. Since methods according to certain embodiments of present invention described herein are relatively simple, the production cost may be effectively reduced as compared to the aforementioned illuminating device of the prior art.

Figure 17:
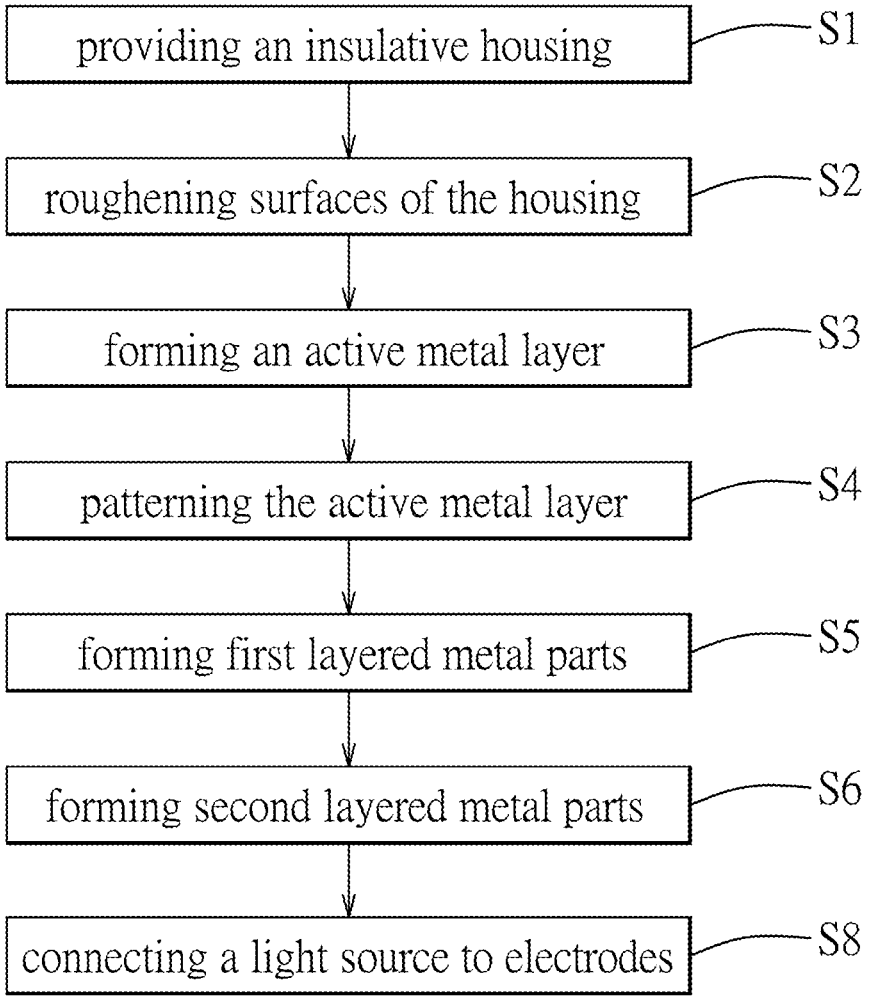
FIG. 17 is a flow chart of an embodiment of a method for making the illuminating device.
Figure 18:
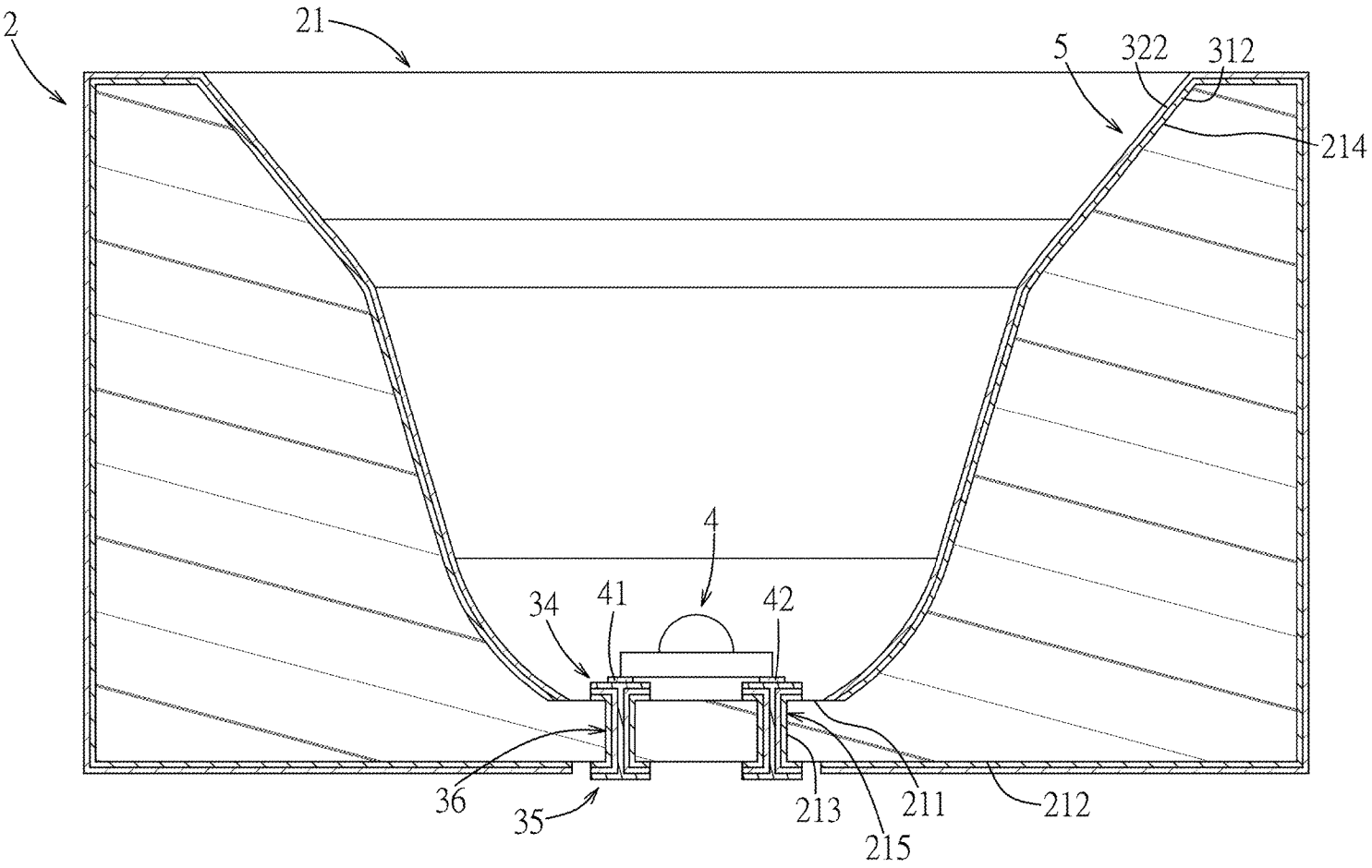
FIG. 18 is a sectional view showing the illuminating device provided by the method of FIG. 17.

Referring to FIGS. 17 and 18, another exemplary embodiment of a method for making illuminating device 200 is shown. Difference includes that Step S7 is omitted in this illustrated exemplary embodiment. That is to say, the first and second non-electrode forming regions 312, 322 are retained on the insulative housing 2. The first non-electrode forming region 312 and the second non-electrode forming region 322, which are located on the surrounding surface 214, respectively serve as a first reflective metal layer and a second reflective metal layer to constitute a reflective metal cover 5 on the surrounding surface 214 for reflecting light generated from the light source 4. By such, lighting efficiency of the illuminating device 200 can be improved as compared to the aforementioned illuminating device of the prior art.

Figure 19:
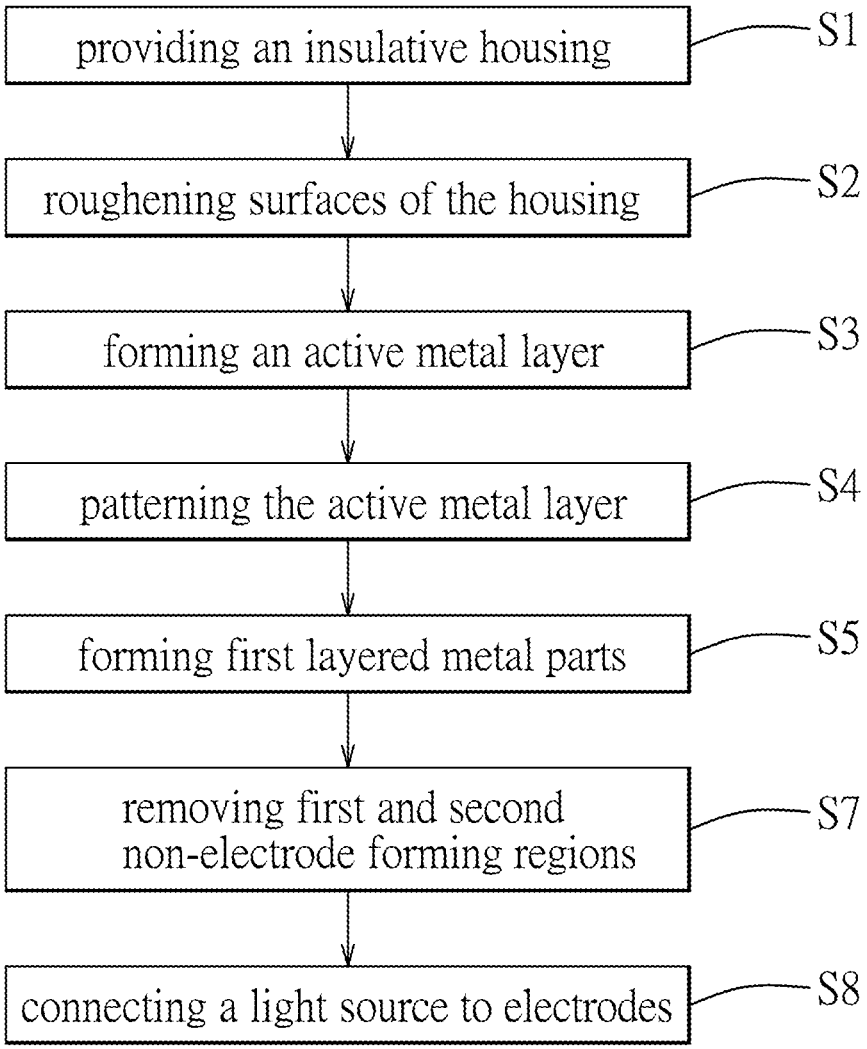
FIG. 19 is a flow chart of an embodiment of the method.
Figure 20:
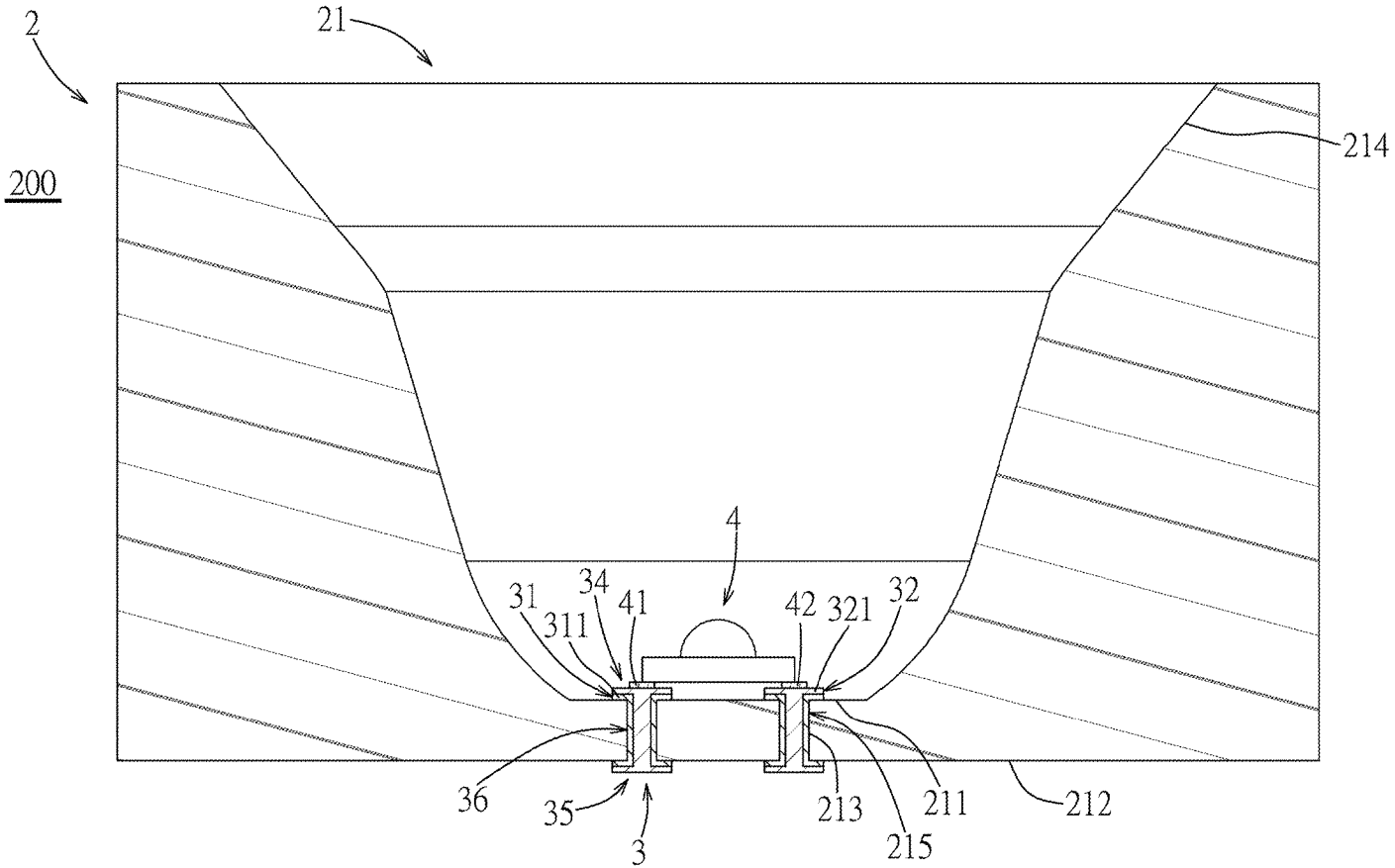
FIG. 20 is a sectional view showing the illuminating device provided by the method of FIG. 19.

Referring to FIGS. 19 and 20, another exemplary embodiment of a method for making the illuminating device 200 is similar to that of the embodiment of FIGS. 7 to 16. Differences include that Step S6 is omitted in this exemplary embodiment. That is to say, the forming of the second layered metal parts is omitted, and each of the electrodes 3 of the resultant illuminating device 200 only includes the layered active metal part 31 and the first layered metal part 32 (i.e., the two-layered structure).

Figure 21:
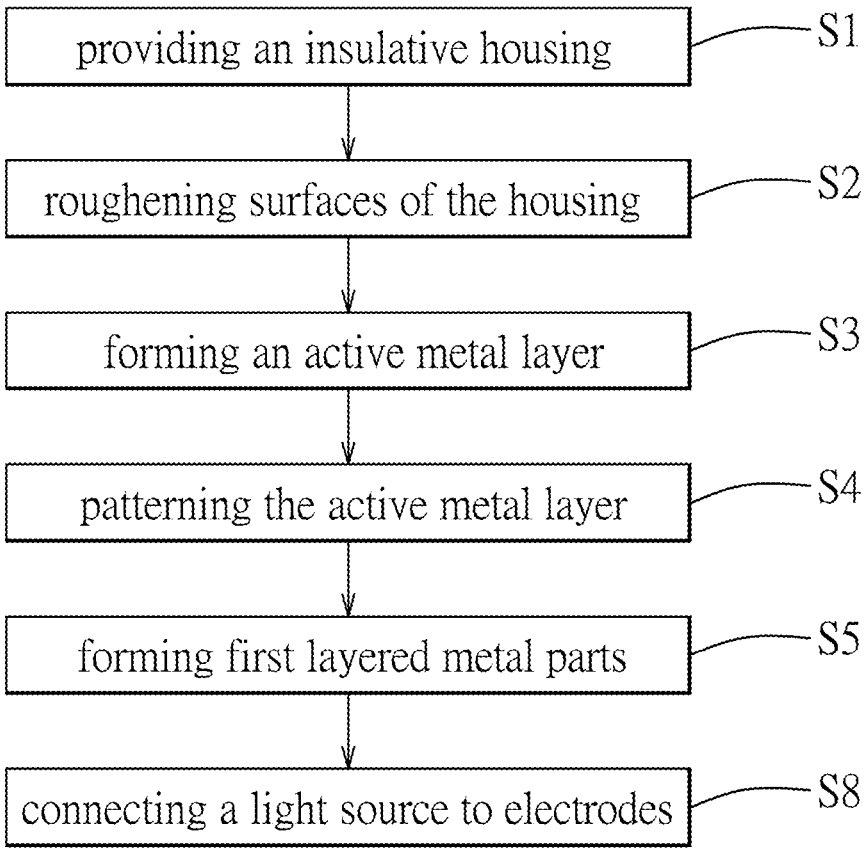
FIG. 21 is a flow chart of an embodiment of the method.
Figure 22:
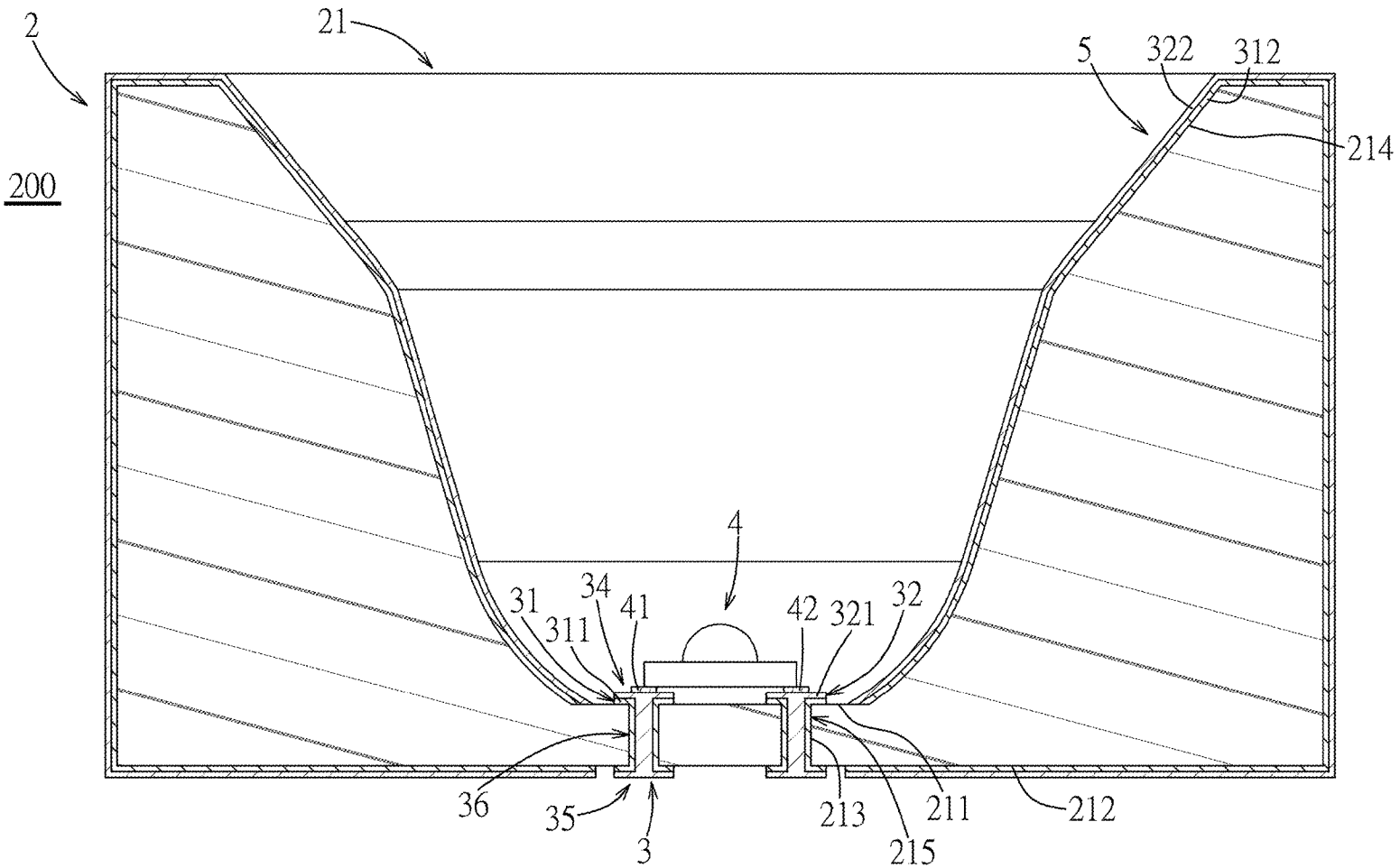
FIG. 22 is a sectional view showing the illuminating device provided by the method of FIG. 21.

Referring to FIGS. 21 and 22, another exemplary embodiment of a method for making the illuminating device 200 is similar to that of the exemplary embodiment of FIGS. 7 to 16. Differences includes that both of Steps S6 and S7 are omitted in this exemplary embodiment. That is, the electrodes 3 of the resultant illuminating device 200 have the two-layered structure, and the reflective metal cover 5 is formed.

Figure 23:
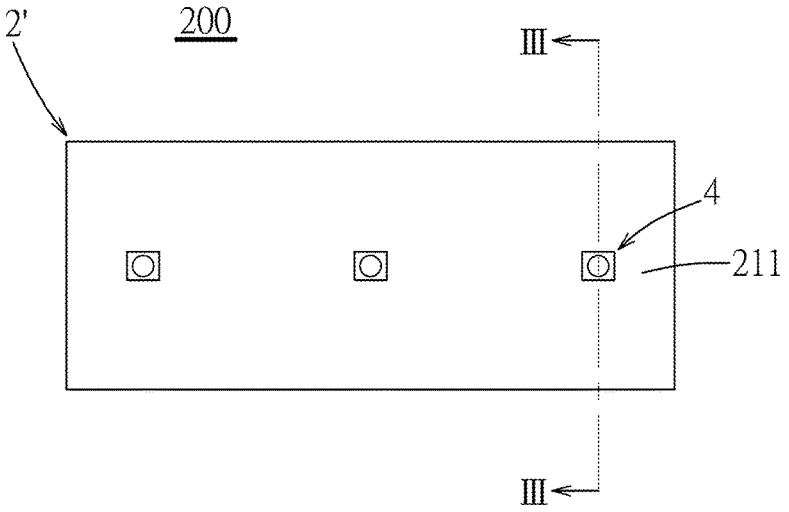
FIG. 23 is a top plan view of an embodiment.
Figure 24:
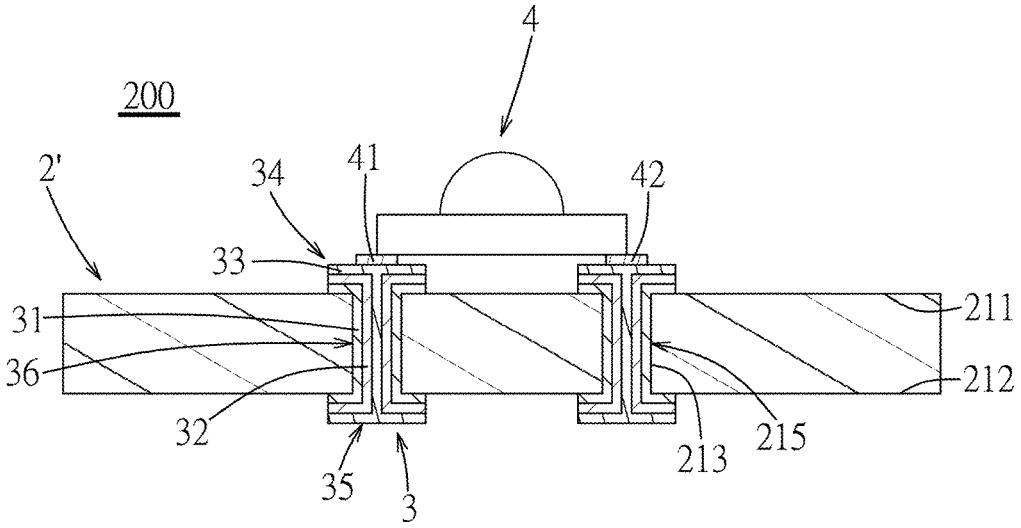
FIG. 24 is a sectional view taken along line III-III in FIG. 23.

Referring to FIGS. 23 and 24, another exemplary embodiment of a method for making the illuminating device 200 is similar to that of the embodiment of FIGS. 7 to 16. Differences include that, in Step S1 of this exemplary embodiment, the insulative housing 2' is configured to be planar, and the surrounding surface 214 of the mount body 21 is omitted.

Another exemplary embodiment of a method for making the illuminating device 200 according to the present invention is similar to that of the exemplary embodiment of FIGS. 7 to 16. Differences include that the forming of the layered active metal parts 31 is conducted by screen printing (or other printing methods) to directly form the layered active metal parts 31 onto the roughened zones 216 instead of the forming and the patterning of the active metal layer 31'.

Another exemplary embodiment of a method for making the illuminating device 200 according to the present invention is similar to that of the embodiment of FIGS. 7 to 16. Differences include that Step S5 is performed prior to Step S4 by forming a first metal layer (not shown) on the active metal layer 31', and then patterning simultaneously the active metal layer 31' and the first metal layer into the layered active metal parts 31 and the first layered metal parts 32.

In general, a method for making an illuminating device according to certain embodiments of the present invention includes:

providing an insulative housing that includes at least substantially oppositely disposed front and rear surfaces, and at least one through hole defined by a hole wall and penetrating the front and rear surfaces;

forming an electrode inside the through hole, the electrode extending to the front and rear surfaces and including a layered active metal part formed on the hole wall, and a first layered metal part formed on the layered active metal part; and disposing a light source proximate the front surface and connecting electrically at least one connecting terminal of the light source to one end of the electrode extending to the front surface of the insulative housing.

In certain embodiments, by virtue of the configuration of the electrodes 3 and the insulative housing 2, the illuminating device 200 of the present invention has relatively few components, thereby resulting in a relatively simple process and effectively reducing the production costs as compared to the aforementioned illuminating device of the prior art. In addition, the electrodes 3 of the illuminating device 200 may serve as heat-dissipating paths to improve the heat dissipation efficiency of the illuminating device 200.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An illuminating device, comprising:

an insulative housing including at least substantially oppositely disposed front and rear surfaces and at least two spaced-apart through holes, each of the through holes being defined by a hole wall and penetrating the front and rear surfaces; and at least two electrodes, each electrode including a first conductive segment formed proximate the front surface, a second conductive segment formed proximate the rear surface, and a connecting segment formed inside a respective one of the through holes to electrically interconnect the first conductive segment and the second conductive segment, wherein the first conductive segment, the second conductive segment and the connecting segment are formed from at least a layered active metal layer part formed on and extending from the hole wall of the respective one of the through holes to a portion of each of the front and rear surfaces.

2. The illuminating device according to claim 1, wherein the first conductive segment, the second conductive segment and the connecting segment are further formed from a first layered metal part formed on the layered active metal layer part and extending through the respective one of the through holes.

3. The illuminating device according to claim 1, further comprising:

a light source disposed proximate the front surface and electrically coupled to the first conductive segment of a corresponding one of the electrodes.

4. The illuminating device according to claim 1, wherein each of said electrodes further includes a second layered metal part formed on said first layered metal part, so that said layered active metal part, said first layered metal part and said second layered metal part cooperatively constitute said first and second conductive segments and said connecting segment.

5. The illuminating device according to claim 2, further comprising:

a reflective metal cover; and a second reflective metal cover, wherein the insulative housing further includes a surrounding surface extending around and projecting outwardly from a periphery of the front surface, wherein the reflective metal cover being formed on the surrounding surface for reflecting light generated from the light source, and wherein the reflective metal cover includes a first reflective metal layer formed on the surrounding surface and made of a material identical to that of the layered active metal part, and wherein the second reflective metal layer being formed on the first reflective metal layer and made of a material identical to that of the first layered metal part.

6. The illuminating device according to claim 3, further comprising:

a reflective metal cover, wherein the insulative housing further includes a surrounding surface extending around and projecting outwardly from a periphery of the front surface, and wherein the reflective metal cover being formed on the surrounding surface for reflecting light generated from the light source.

7. A method for making an illuminating device, the method comprising:

providing an insulative housing including at least substantially oppositely disposed front and rear surfaces and at least two spaced-apart through holes, each of the through holes being defined by a hole wall and penetrating the front and rear surfaces; and forming a pair of layered active metal parts, wherein the layered active metal parts are respectively formed on the hole walls of the through holes and extend from the hole walls to a portion of each of the front and rear surfaces, wherein at least the layered active metal parts constitute two electrodes, each electrode including a first conductive segment formed proximate the front surface, a second conductive segment formed proximate the rear surface, and a connecting segment formed inside the hole wall and electrically interconnecting the first and second conductive segments.

8. The method of claim 7, further comprising:

forming a pair of first layered metal parts respectively on the layered active metal parts, the first layered metal parts respectively extending through the through holes, wherein the first layered metal parts respectively cooperate with the layered active metal parts to constitute the two electrodes.

9. The method of claim 8, wherein the forming of the layered active metal parts includes forming an active metal layer on the hole walls and on the front and rear surfaces, and patterning the active metal layer to form the layered active metal p arts.

10. The method of claim 9, further comprising, prior to the forming of the active metal layer, roughening the hole walls of the through holes and portions of each of the front and rear surfaces to form a pair of spaced-apart roughened zones.

11. The method of claim 9, wherein the forming of the active metal layer is conducted by immersing the insulative housing into an aqueous active metal solution, followed by removing the insulative housing from the aqueous active metal solution.

12. The method of claim 9, wherein the forming of the active metal layer is conducted by printing.

13. The method of claim 9, wherein:

the forming of the active metal layer into the layered active metal parts includes patterning the active metal layer to form two first electrode-forming regions which in turn form the layered active metal parts, respectively, and a plurality of first non-electrode forming regions spaced apart from the first electrode-forming regions; and the forming of the first layered metal parts includes forming a patterned first metal layer on the patterned active metal layer by electroless plating, the patterned first metal layer including two second electrode-forming regions which in turn form the first layered metal parts and which are formed onto the first electrode-forming regions, respectively, and a plurality of second non-electrode forming regions onto the first non-electrode forming regions, respectively.

14. The method of claim 13, wherein the active metal layer is patterned by etching.

15. The method of claim 8, wherein the forming of the layered active metal parts and the forming of the first layered metal parts are conducted by forming an active metal layer on the hole walls and on the front and rear surfaces, forming a first metal layer on the active metal layer, and patterning simultaneously the active metal layer and the first metal layer into the layered active metal parts and the first layered metal parts.

16. The method of claim 13, further comprising:

forming a second metal layer on the patterned first metal layer to produce two second layered metal parts respectively on the first layered metal parts by electroplating, wherein each of the second layered metal parts cooperates with a respective one of the first layered metal parts and a respective one of the layered active metal parts to constitute a respective one of the electrodes;

disposing a light source proximate the front surface; and connecting a first connecting terminal and a second connecting terminal of the light source correspondingly to the first conductive segments of the electrodes.

17. The method of claim 13, further comprising:

removing the first non-electrode forming regions and the second non-electrode forming regions;

disposing a light source proximate the front surface; and connecting a first connecting terminal and a second connecting terminal of the light source correspondingly to the first conductive segments of the electrodes.

18. The method of claim 10, wherein the insulative housing further has a surrounding surface extending around and projecting outwardly from a periphery of the front surface, wherein the method further comprises:

during the forming of the active metal layer and the patterned first metal layer, the active metal layer and the patterned first metal layer are further formed on the surrounding surface; and one of the first non-electrode forming regions and one of the second non-electrode forming regions are formed on the surrounding surface and cooperates with each other to form a reflective metal cover on the surrounding surface.

19. A method for making an illuminating device, comprising the steps of:

providing an insulative housing including at least substantially oppositely disposed front and rear surfaces, and at least one through hole defined by a hole wall and penetrating the front and rear surfaces; and forming an electrode inside the through hole by forming at least a layered active metal part on the hole wall of the through hole, the layered metal part extending through the through hole, wherein the electrode extends to the front and rear surfaces.

20. The method of claim 18, further comprising:

forming a first layered metal part on the layered active metal part, the first layered metal part extending through the through hole.

* * * * *